United States Patent [19]

Jih et al.

[11] Patent Number: 4,898,353

[45] Date of Patent: Feb. 6, 1990

[54] BUILT-UP STAND

[76] Inventors: Ronald R. H. Jih, 26, Lane 378, Chung Shan Road, Lu Liao District, Sha Lu Chen, Taichung Shien; Jing-Shuen Chi, 8, Lane 280, Jen Shing Road, Taichung City, both of Taiwan

[21] Appl. No.: 352,298

[22] Filed: May 16, 1989

[51] Int. Cl.[4] ..... A47B 91/00

[52] U.S. Cl. ..... 24.8/188.7; 248/165

[58] Field of Search ..... 248/158, 188.7, 188.1, 248/165, 166, 163.1, 170; 403/174, 175; 108/150

[56] References Cited

U.S. PATENT DOCUMENTS

| | | | |
|---|---|---|---|
| 1,401,330 | 12/1921 | Foote | 248/188.7 |
| 1,604,144 | 10/1926 | Bump | 248/188.7 |
| 1,643,694 | 9/1927 | Bump | 248/188.7 |
| 3,153,524 | 10/1964 | Greenfield | 248/158 |
| 4,084,776 | 4/1978 | Cook | 403/175 X |
| 4,311,294 | 1/1982 | Hawley | 248/165 |
| 4,448,378 | 5/1984 | Binfare | 108/150 X |
| 4,821,986 | 4/1989 | White | 248/188.7 |

FOREIGN PATENT DOCUMENTS

| | | | |
|---|---|---|---|
| 75632 | 9/1949 | Norway | 248/188.7 |

*Primary Examiner*—J. Franklin Foss

*Attorney, Agent, or Firm*—Bacon & Thomas

[57] ABSTRACT

The present invention is related to a built-up stand and, more particularly to a stand to support center post type household furniture or electric home appliance, which is comprises of an upper holder plate, a bottom holder plate and a plurality of base elements, wherein when the bottom holder plate, the base elements and the upper holder plate are attached together, the fastening holes of the bottom holder plate, the base elements and the upper holder plate are arranged to aim at one another, to allow a bolt screw means to screw thereinto and to further be fastened up with a wing nut. According to the present invention, the assembly is detachable to minimize packing size.

3 Claims, 5 Drawing Sheets

BUILT-UP STAND

BACKGROUND OF THE INVENTION

Conventional center post type built-up stand, as shown in FIG. 4, is comprised of two rectangular hollow bars intersected with each other for mounting thereon of the center post, wherein each rectangular hollow bar is having a notch made in the middle and arranged in a depth equal to ½ of the height of the rectangular hollow bar such that when two rectangular hollow bars are connected together the notch of one rectangular hollow bar can be engaged with the notch of the other rectangular hollow bar.

This type of built-up stand is not very practical due to the drawbacks as hereunder:

<1> Packing size can not be minimized. Because the stand is comprised of two rectangular bars intersected with each other, the rectangular bar shall have a reasonable length. In order to reinforce the structure, the height of the rectangular bar shall be properly extended for setting of the notch. Because the size of the rectangular bar can not be minimize, the packing and transportation cost is relatively increased.

<2> The component parts are convenient to manufacture. The rectangular hollow bar is made of a rectangular metal plate, which is firstly punched to provide a notch and then, be folded to form into a rectangular hollow bar. Further, the two rectangular hollow bars of each stand are not identical, and they are respectively made through different process. Therefore, the manufacturing process of this type of built-up stand is rather complicated and difficult to control.

<3>High production efficiency is difficult to achieve. Because the two rectangular hollow bars of each stand are similar but not identical, they are difficult to identify during packing process. Therefore, high production efficiency becomes difficult to achieve.

<4>Limited combination. Because the stand is comprised of two rectangular hollow bars intersected with each other, the configuration is fixed and not changeable.

SUMMARY OF THE INVENTION

The present invention is to provide a built-up stand, which includes an upper holder plate to match with a bottom holder plate so as to fasten up a plurality of base elements set therebetween through screw joint. According to the present invention, all the component parts are applicable for mass production to reduce the cost. Because of built-up design, the whole assembly is detachable to minimize packing size for convenient delivery with less transportation expense.

The features and advantages of the present invention may be fully understood from the following detailed description considered in connection with the annexed drawings as hereunder.

DETAILED DESCRIPTION OF THE PREFERRED EMBODIMENTS

Figure 1:
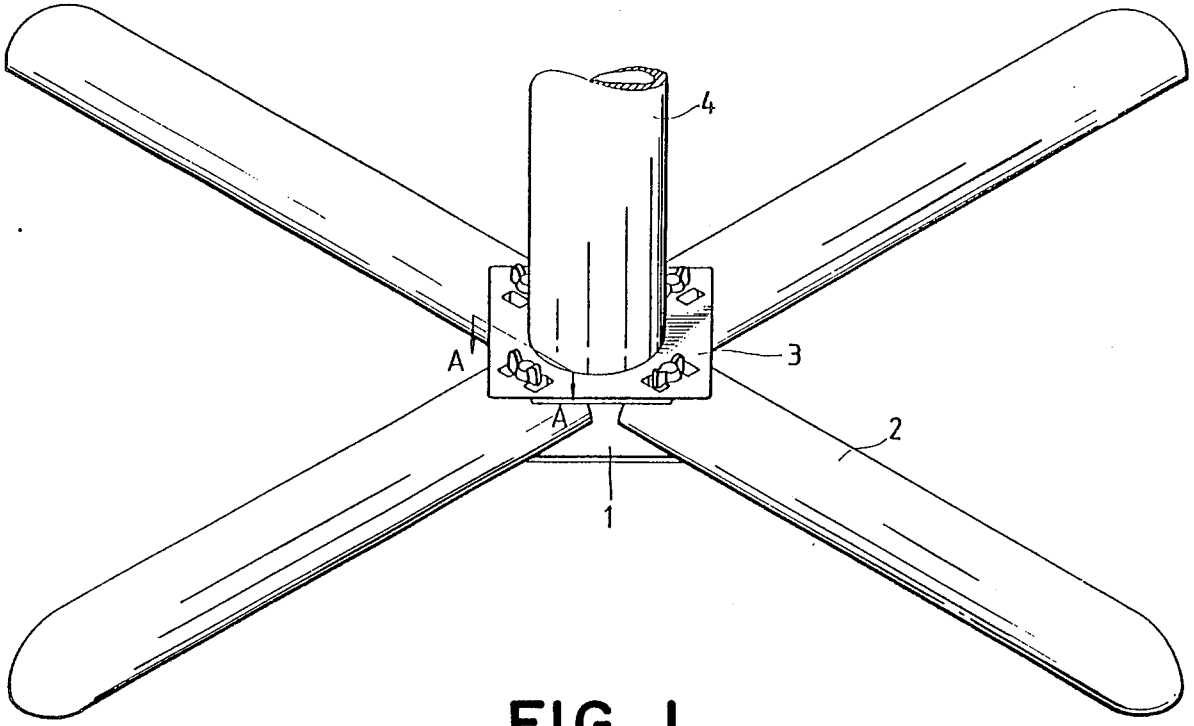
FIG. 1 is a perspective schematic drawing of a built-up stand embodying the present invention.
Figure 2:
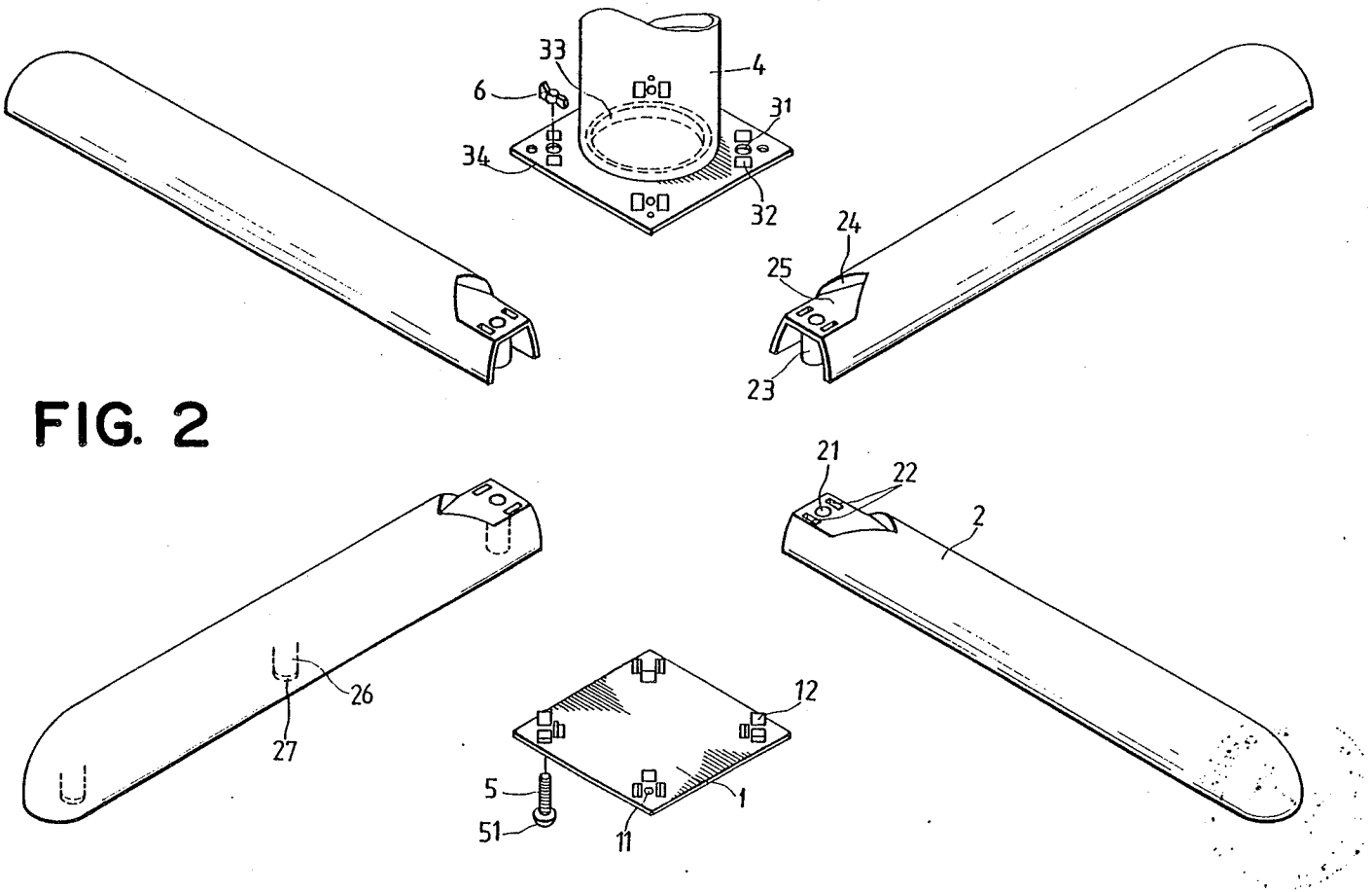
FIG. 2 is a perspective exploded view of the preferred embodiment of FIG.-1.

Referring to the FIG. 2, a built-up stand is comprised of a bottom holder plate (1), a plurality of base elements (2) and an upper holder plate (3). The upper holder plate (3) is a square board having a flanged ring (33) set at the top in the middle for mounting thereon of a center post (4) through sleeve joint. A plurality of fastening holes (31) are made on the upper holder plate (3) between the flanged ring (33) and the side edge (34) near the corners. Two retainer means (32) are integrally made at both sides of each fastening hole (31) by means of punching process, which retainer means (32) are to be set in the retainer holes (22) of the base elements (2) to let the upper holder pate (3) be firmly positioned when the upper holder plate (3) is connected to the base elements (2).

The base element (2) which is to be attached to the upper holder plate (3) at the bottom is having a recessed front end to form into a plane (25) which is including a fastening hole (21) with two retainer holes (22) set at both lateral sides, wherein the retainer holes (22) and the fastening hole (21) are properly arranged to match with the retainer means (32) and the fastening hole (31) of the upper holder plate (3). When in assembly, the retainer means (32) of the upper holder plate (3) are inserted into the retainer holes (22) of the base element (2) with the fastening hole of the upper holder plate (3) aimed at the fastening hole of the base element (2) so as to let a bolt screw means (5) be inserted thereinto to screw up the upper holder plate (3) with the base element (2). According to the present invention, the base element (2) is having a ⊓-shaped cross section, and respectively connected with the upper and bottom holder plates (3) and (1) by means of screw joint. The base element (2) is also having a hollow stub (23) set below the fastening hole (21) to retain the bolt screw means (5), which screws into the fastening hole (21), and to match with the locating plates (12) of the bottom holder plate (1) for positioning.

The bottom holder plate (1) is a square board having a plurality of fastening holes (11) made thereon to match with the fastening holes (31) of the upper holder plate (3). A locating plate (12) is respectively set at the left, right and inner side of each fastening hole (11), wherein the three locating plates (12) which encircle the fastening hole (11) define a space just suitable for setting therein of the hollow stub (21) of the base element (2) to let the fastening hole (21) of the base element (2) be aimed at the fastening hole (11) of the bottom holder plate (1).

Figure 3:
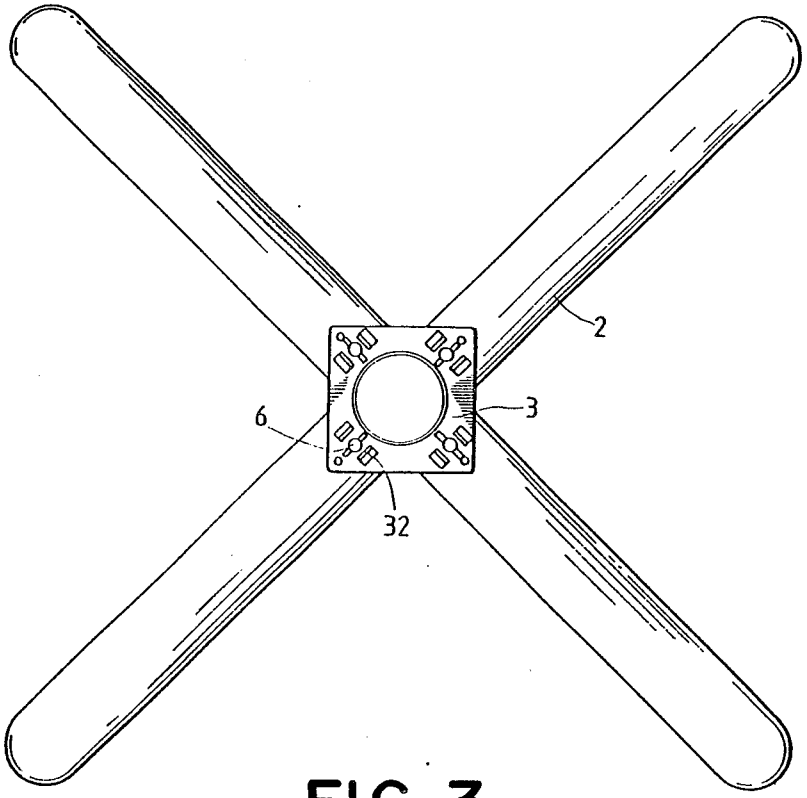
FIG. 3 is a top view of the preferred embodiment of FIG.-1.
Figure 6:
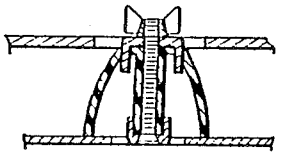
FIG. 6 is a cross of one of the base elements.

When the bottom holder plate (1), the base elements (2) and the upper holder plate (3) are attached together, the fastening holes (11), (21) and (31) are arranged to aim at one another, to allow a bolt screw means (5) to screw thereinto and to further be fastened up with a wing nut (6) (as shown in FIG. 3).

Because the bottom holder plate (1) is to be connected with the base element (2) at the bottom, in order to prevent from unstable state, the base element (2) is arranged to provide a plurality of short struts (26) set at the inner side, which short struts (26) are respectively connected with an antiskid rubber cushion (27) and arranged to align with the bottom surface of the bottom holder plate (1) to stabilize the base element (2).

Figure 4:
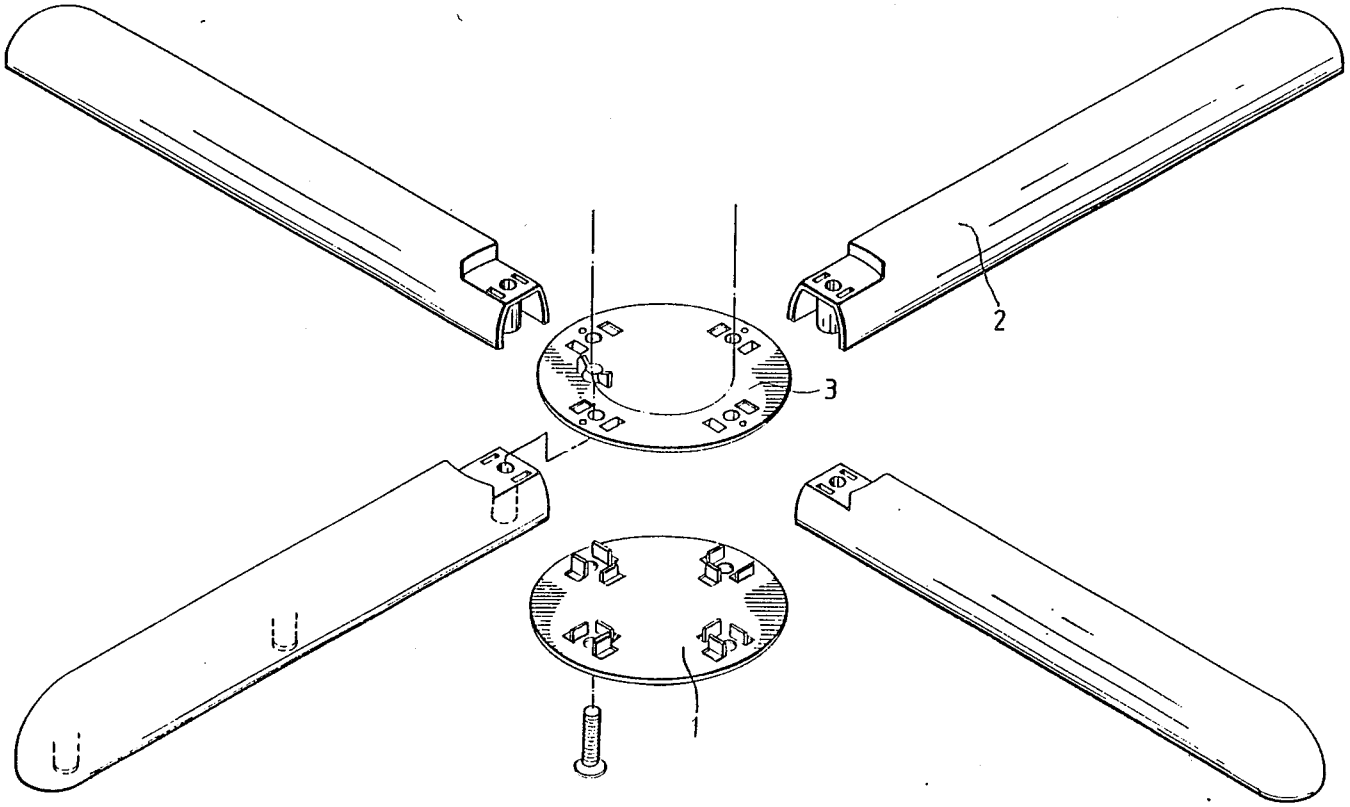
FIG. 4 is a perspective exploded view of another preferred embodiment according to the present invention.
Figure 5:
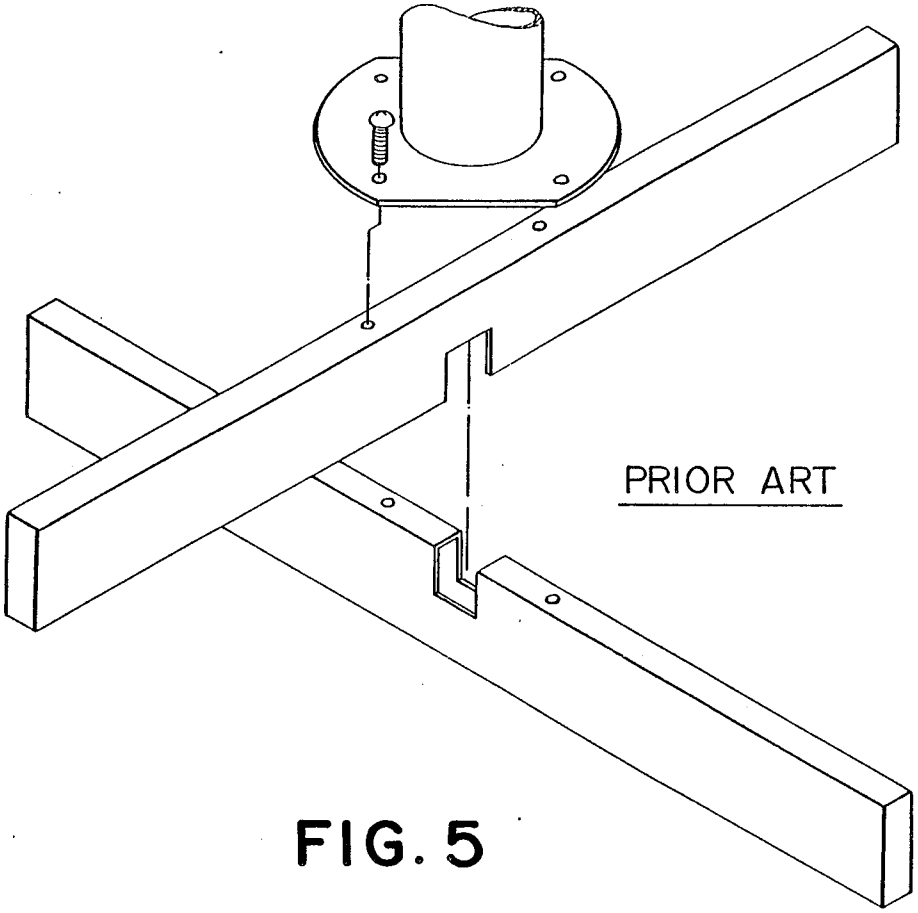
FIG. 5 is a perspective exploded view of the prior art.

According to the present invention, the upper and bottom holder plates (3) and (1) may have a square, round, or any equilateral shape, wherein the fastening holes (31) or (11) are arranged in number equal to the base elements (2) used, that is, the number of base element may be flexibly arranged according to actual demand, so as to provide maximum performance in all details. When the upper holder plate (3) is changed in shape, the edge (24) at the back side of the plane (25) of the base element (2) shall be changed accordingly so as to perfectly match with the shape of the upper holder plate (3), that is, the shape of the edge (24) is to be changed according to the associated side edge (34) of the upper holder plate (3), which may have a curved shape (as shown in FIG. 4) or may be like a segment of a circle to provide a contained angle (as shown in FIG. 2).

In the present invention, the upper and bottom holder plates (3) and (1) are made through shape-punching process, and the base element (2) is made through injection molding process. Therefore, all the component parts of the present invention are simple to manufacture and convenient for mass production.

In conclusion, as described above, the present invention includes various features as hereunder:

<1>All component parts are easy to manufacture. Through mass production, the cost can be drastically reduced.

<2>Because the base elements are identical, packing mistake can be eliminated.

<3>Because all component parts are detachable, packing size can be minimized to reduce transportation cost.

<4>Because the number of the base elements and the shape of the holder plates can be flexibly changed according to requirement, diversified combination becomes possible.

We claim:

1. A built-up stand comprised of a bottom holder plate, a plurality of base elements and an upper holder plate, wherein the upper holder plate is comprising plurality of fastening holes made thereon with two retainer means integrally made at both sides of each of the fastening holes; the base elements each having a recessed front end to form into a plane which is including a fastening hole with two retainer holes set at both lateral sides, and also comprising a hollow stub set below its fastening hole; the bottom holder plate having a plurality of fastening holes made thereon to match with the fastening holes of the upper holder plate, with a locating plate respectively set at the left, right and inner side of each the fastening hole of the bottom holder plate to let the three locating plates which encircle the fastening hole of the bottom holder plate define a space just suitable for setting therein of the hollow stub of the base element, and wherein when the bottom holder plate, the base elements and the upper holder plate are attached together, the fastening holes of the bottom holder plate, the base elements and the upper holder plate are arranged to aim at one another, to allow a bolt screw means to screw thereinto and to further be fastened up with a wing nut.

2. The built-up stand as set forth in claim 1, wherein the number of the base elements used is equal to the number of the fastening holes of the upper holder plate and the bottom holder plate.

3. The built-up stand as set forth in claim 1, wherein the upper holder plate and the bottom holder plate may have a square or round or any equilateral shape.

* * * * *